US010648207B2

(12) United States Patent
Doring

(10) Patent No.: US 10,648,207 B2
(45) Date of Patent: May 12, 2020

(54) OPENING CONTROL DEVICE FOR CASEMENT WINDOW

(71) Applicant: Truth Hardware Corporation, Owatonna, MN (US)

(72) Inventor: Craig M. Doring, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 209 days.

(21) Appl. No.: 15/699,708

(22) Filed: Sep. 8, 2017

(65) Prior Publication Data

US 2019/0078365 A1 Mar. 14, 2019

(51) Int. Cl.

| | |
|---|---|
| ***E05C 17/08*** | (2006.01) |
| ***E05C 17/24*** | (2006.01) |
| ***E05D 11/10*** | (2006.01) |
| ***E06B 3/32*** | (2006.01) |
| ***E06B 3/36*** | (2006.01) |

(52) U.S. Cl.

CPC ..... *E05C 17/08* (2013.01); *E05C 17/24* (2013.01); *E05D 11/1028* (2013.01); *E06B 3/325* (2013.01); *E06B 3/36* (2013.01)

(58) Field of Classification Search

CPC ..... E05C 17/08; E05C 17/085; E05C 17/12; E05C 17/14; E05C 17/24; E05C 17/28

See application file for complete search history.

(56) References Cited

U.S. PATENT DOCUMENTS

| | | | | |
|---|---|---|---|---|
| 1,015,222 | A * | 1/1912 | Von Gunten | E05C 17/24 292/272 |
| 1,633,645 | A * | 6/1927 | Molberg | E05C 17/14 292/267 |
| 4,932,695 | A * | 6/1990 | Pettit | E05C 17/085 292/267 |
| 6,279,979 | B1 * | 8/2001 | Cauley | B62D 33/0273 292/262 |
| 8,418,404 | B2 * | 4/2013 | Gramstad | E05C 17/24 49/141 |
| 8,505,240 | B2 * | 8/2013 | Nguyen | E05C 17/24 16/363 |
| 8,726,572 | B2 * | 5/2014 | Derham | E05C 19/003 49/141 |
| 8,813,424 | B2 * | 8/2014 | Nguyen | E05C 17/24 16/364 |
| 9,115,529 | B2 * | 8/2015 | Liang | E05F 11/16 |
| 9,428,945 | B2 * | 8/2016 | Nguyen | E05C 17/24 |
| 2011/0173895 | A1 * | 7/2011 | Lund | E05C 17/30 49/501 |

* cited by examiner

*Primary Examiner* — Catherine A Kelly
(74) *Attorney, Agent, or Firm* — Bradley J. Thorson

(57) ABSTRACT

A casement window opening control device including a sash sub-assembly and a frame sub-assembly. The device is self-locating by aligning the bottom end of each sub-assembly with physical features of the window. This saves time and effort in installation by not requiring any measurements to ensure that an engaging feature of the limiting arm of the device is aligned with an engaging feature of the frame sub-assembly so that the device properly reengages upon closing of the sash after release. Also, operation of the release of the travel limiting arm is intuitive, requiring only pressing in on a latch button and sliding it upwardly to effect release.

10 Claims, 10 Drawing Sheets

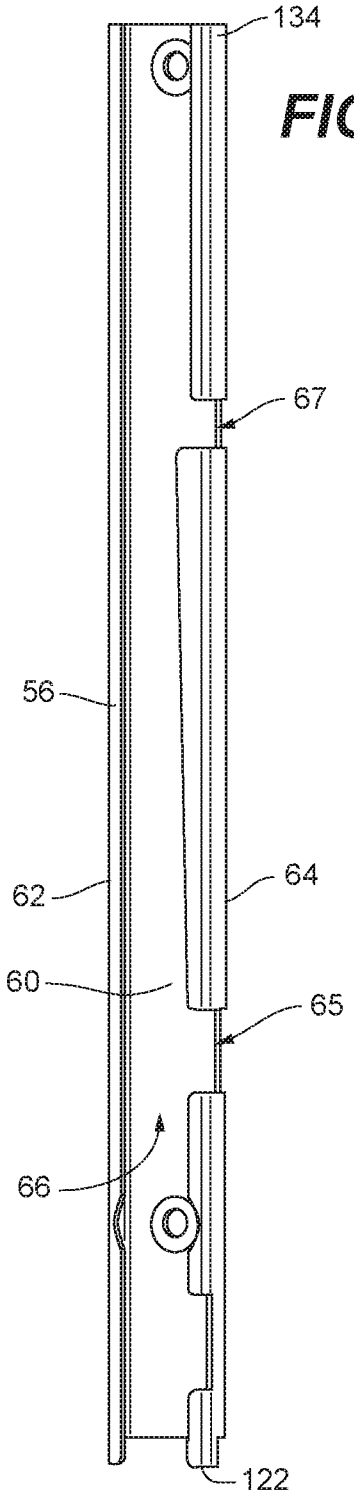
FIG. 11
FIG. 12
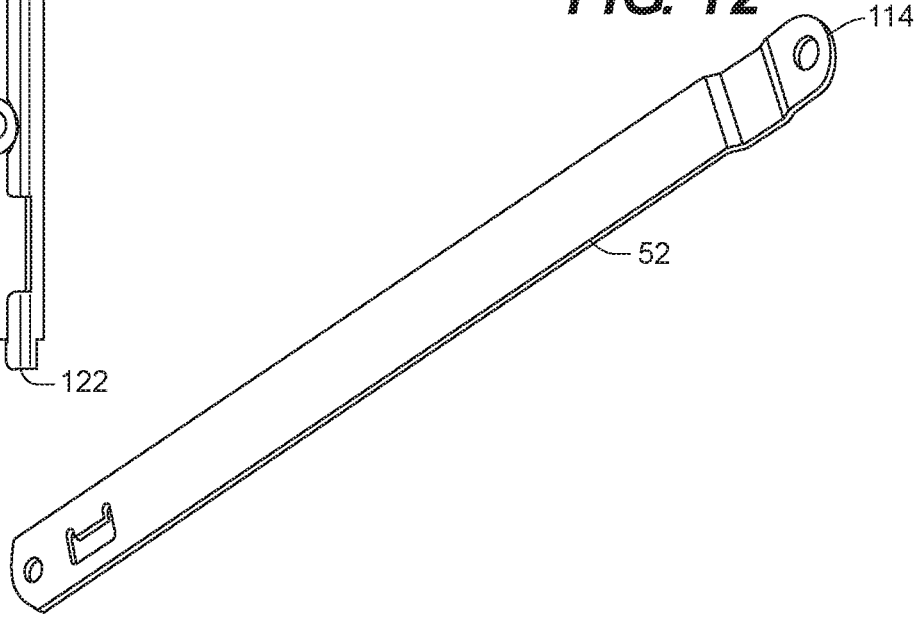

OPENING CONTROL DEVICE FOR CASEMENT WINDOW

TECHNICAL HELD

The present invention relates to casement and awning windows and, more specifically, to devices for limiting the opening of casement and awning windows.

BACKGROUND

A casement or an awning window generally refers to a sash that is attached to its frame by one or more hinges. The hinges can be located on any side of the sash and the frame though generally not on the lower edge of the sash and frame. In general, a casement window rotates along a horizontal plane (the hinges of a casement window defining a vertical rotation axis), while an awning window rotates along a vertical plane (the hinges of an awning window defining a horizontal rotation axis). Most casement and awning windows which employ the use of a crank lever or cam handle operator open outwardly so as not to interfere with the operator of the window.

An advantage of many casement and awning windows is that substantially the full window opening can be exposed without requiring the removal of the window from the frame. In contrast, for example only half of the opening of a double-hung window can be exposed by raising the lower sash or lowering the upper sash. The sashes of double hung or horizontally sliding windows must be completely removed from the frame to expose the entire window opening.

The ability of casement windows to be opened so as to fully expose the window opening also can be disadvantageous, however. In certain instances, some casement and awning windows can be opened wide enough that individuals or large objects can fit through the opening.

Recent modifications to building codes and window safety standards have been implemented in an effort to prevent or deter injuries to individuals, particularly children, from falling out of open windows. For example, proposed changes to the International Building Code ("IBC") and the International Residential Code ("IRC") aimed at child window safety require that certain windows be fitted with window opening control devices. Such window opening control devices may limit the ability of casement windows to be opened beyond a certain point. This limited opening is typically defined by the maximum diameter of a hypothetical sphere that is allowed to pass through the window opening when the sash of the window is opened to the limited position. For example, current CTC safety standards stipulate that a 4-inch diameter sphere shall not pass the opening of a casement or awning window when the opening is in its largest opened position.

At times, there may be a need to override the window opening limit device so that the casement window can be opened beyond the limited position. In particular, it may be necessary to fully open the window. During an emergency, for example, an egress casement window opening may provide an escape route for individuals or an access route for emergency personnel. Accordingly, building and residential codes may require window opening limit devices to be equipped with a release mechanism. The need may also exist that such window opening limit devices be operable without keys, tools, or special knowledge and deter or prevent operation by young children.

Unless the window opening limit device is reengaged once released, casement windows could potentially be operated so as to allow the window opening to be fully exposed. Subsequent users, for example, may not realize that the window is equipped with such a device or that the device has been released. Therefore, there exists a need for window opening limit devices to possess the capability to be self re-engaging even if a user does not intend to reengage the device through the user's actions.

The cost of replacing windows is often significant. Therefore, there also exists a need for a window opening limit device that can be installed onto existing casement windows. In addition, existing casement and awning windows are not uniform in size. In fact, the size of casement and awning windows can vary substantially.

Prior attempts have been made to provide a window opening control device to address these issues. One example can be found in U.S. Pat. No. 8,505,240, issued Aug. 13, 2013, and entitled CASEMENT AND AWNING WINDOW OPENING LIMIT DEVICE, said patent being hereby fully incorporated herein by reference.

A drawback of such prior devices, however, is that they can be difficult to locate on the window frame and sash, thereby requiring additional time and effort during assembly. Therefore, there exists a further need for a window opening limit device that can be easily installed regardless of the dimensions of the window frame.

SUMMARY

Embodiments of the present invention address the drawbacks of prior window opening control devices. In particular, a sash sub-assembly and a frame sub-assembly are self-locating by aligning the bottom end of each sub-assembly with physical features of the window. This saves time and effort in installation by not requiring any measurements to ensure that an engaging feature of the limiting arm of the device is aligned with an engaging feature of the frame sub-assembly so that the device properly reengages upon closing of the sash after release. Also, operation of the release of the travel limiting arm is intuitive, requiring only pressing in on a latch button and sliding it upwardly to effect release, Operation of the device is compliant with ASTM standard F2090, requiring two different types of action to effect release. In addition, the mechanics of operation of the latch button assists in preventing unintended release of the mechanism, thereby providing additional safety.

According to an embodiment, a window opening control device includes a track assembly adapted to be attached to a frame of a casement window, the track assembly including a track and a carriage assembly slidable in the track, a sash attachment member adapted to attach to a sash of the casement window, the sash attachment member having an upper end, and a limit arm presenting a first end and a second end, the first end of the limit arm pivotally coupled to the sash attachment member proximate the upper end of the sash attachment member, the limit arm having a fastening button projecting outwardly therefrom proximate the second end, wherein in a window opening limiting condition, the fastening button is engaged with the carriage assembly so that an initial range of opening travel of the sash is limited by the limit arm, wherein in a released condition the fastening button is free from the carriage assembly, thereby enabling the sash to be opened beyond the initial range of opening travel, and vherein when the sash is closed, the fastening button automatically reengages with the carriage assembly after release.

In embodiments, the carriage assembly includes a housing defining a recess and a latch plate slidably received in the housing. The latch plate has a latch hook, and the carriage assembly further includes a latch button operable to selectively shift the latch plate between a latched position wherein the latch hook extends into the recess, and an unlatched position wherein the latch hook is retracted from the recess. The limit arm can be released by a first pressing movement and a second sliding movement of the latch button.

In embodiments, the limit are includes a projecting fastening button, the fastening button being engaged in the recess behind the latch hook when the window opening control device is in the window opening limiting condition.

In embodiments, a bottom end of the track is abutted with a bottom member of the frame and a bottom end of the sash attachment member is aligned with a bottom edge of a bottom rail of the sash such that the fastening button is registered with the recess when the window opening control device is in the released condition. The latch plate can be spring-biased toward the latched position.

In other embodiments, a casement window includes a frame defining an opening, a sash hinged to the frame to selectively close the opening, and a window opening control device. The window opening control device includes a track assembly attached to the frame, the track assembly including a track and a carriage assembly slidable in the track, a sash attachment member attached to the sash, the sash attachment member having an upper end, and a limit arm presenting a first end and a second end, the first end of the limit arm pivotally coupled to the sash attachment member proximate the upper end of the sash attachment member, the limit arm having a fastening button projecting outwardly therefrom proximate the second end, wherein in a window opening limiting condition, the fastening button is engaged with the carriage assembly so that an initial range of opening travel of the sash is limited by the limit arm, wherein in a released condition the fastening button is free from the carriage assembly, thereby enabling the sash to be opened beyond the initial range of opening travel, and wherein when the sash is closed, the fastening button automatically reengages with the carriage assembly after release.

In further embodiments, a method of installing a window opening control device on a casement window includes abutting the bottom end of a track assembly against a bottom member of the frame, the track assembly including a track and a carriage assembly slidably disposed in the track, the carriage assembly defining a recess, and securing the track assembly to the frame in this position. The method further includes pivotally coupling a limit arm to a sash attachment member proximate a top end of the sash attachment member, aligning a bottom end of the sash attachment member with a bottom edge of a bottom rail of the sash so that a fastening button of the limit arm is registered with the recess of the carriage assembly, and fastening the sash attachment member to the sash.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which:

FIG. 11 is an isometric view of the track of the window opening control device depicted in FIG. 2;

FIG. 12 is an isometric view of the limit arm of the window opening control device depicted in FIG. 2.

Figure 1:
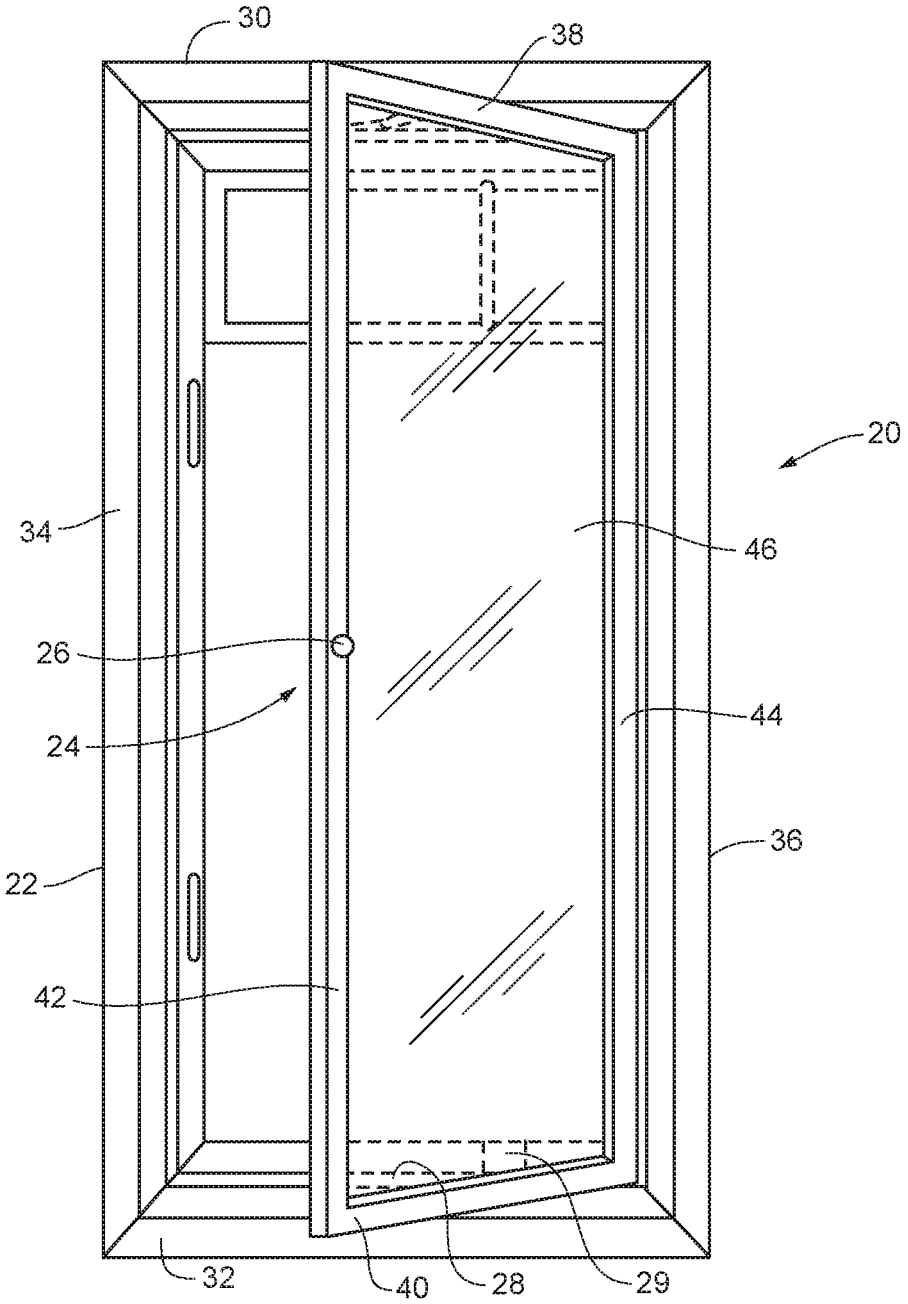
FIG. 1 depicts a casement window according to an embodiment of the invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

As depicted in FIG. 1, casement window 20 generally includes frame 22 defining opening 24 and sash 26. Sash 26 is coupled to frame 22 with hinges 28 at the top and bottom so as to enable sash 26 to swing in order to close opening 24, as driven by opener 29. Frame 22 generally includes top member 30, bottom member 32, and side members 34, 36. Sash 26 generally includes top rail 38, bottom rail 40, and side rails 42, 44, retaining glass 46.

Window opening control device 48 is depicted in FIGS. 2-12, and generally includes track assembly 50, limit arm 52, and sash attachment member 54. Track assembly 50 generally includes track 56 and carriage assembly 58. Track 56 has a c-shaped cross-section and generally includes back plane 60 with upstanding flanges 62, 64, at each lateral edge, defining channel 66. Entrance opening 65 and exit opening 67 are defined in flange 64.

Carriage assembly 58 generally includes housing back-plane 68, latch plate 70, and front housing cover 72. Housing back-plane 68 defines spring recess 74, parallel guide tracks 76, cutout 78, and securing tabs 80. Front housing cover 72 defines aperture 82, cutout 84, and securing recesses 86. Latch plate 70 defines opening 88, spring slot 90, latch hook 92, and guide member 93.

Front housing cover 72 snaps onto housing back-plane 68 with securing tabs 80 received in securing recesses 86. Latch plate 70 is slidably received between housing back plane 68 with opening 88 registered with aperture 82. Cutout 78 is registered with cutout 84 thereby defining recess 94. Latch hook 96 extends into recess 94. Spring 98 is received in spring recess 74 and spring slot 90, and spring 98 is arranged to bias latch plate 70 downward. Latch button 100 extends through opening 88 and aperture 82, and defines side projections 102 which are received on either side of guide tracks 76 in slots 103 such that latch button 100 is slidable on guide tracks 76. Biasing spring 104 biases latch button 100 away from housing back plane 68. Projections 106 are receivable in apertures 108 on either side of aperture 82. Top face 110 of latch button 100 bears against top edge 112 of opening 88. Carriage assembly 58 is slidably received in channel 66 of track 56 with guide member 93 riding in channel 66 to inhibit twisting of carriage assembly 58 relative to track 56 under load.

Limit arm 52 is pivotally coupled at top end 114 to top end 116 of sash attachment member 54. Fastening button 120 projects outwardly proximate opposing end 118 of limit arm 52.

Window opening control device 48 can be installed on casement window 20 by abutting back plane 60 of track 56 against side member 36 of frame 22 with bottom end 122 abutting bottom member 32. Track 56 can be secured to side member 36 with fasteners 124. Sash attachment member 54 is secured to side rail 44 of sash 26 with fasteners 126 and with locating feature 127 hooked over bottom facing surface 129 of bottom rail 40. Bottom end 128 is aligned with bottom edge of side rail 44.

Figure 3:
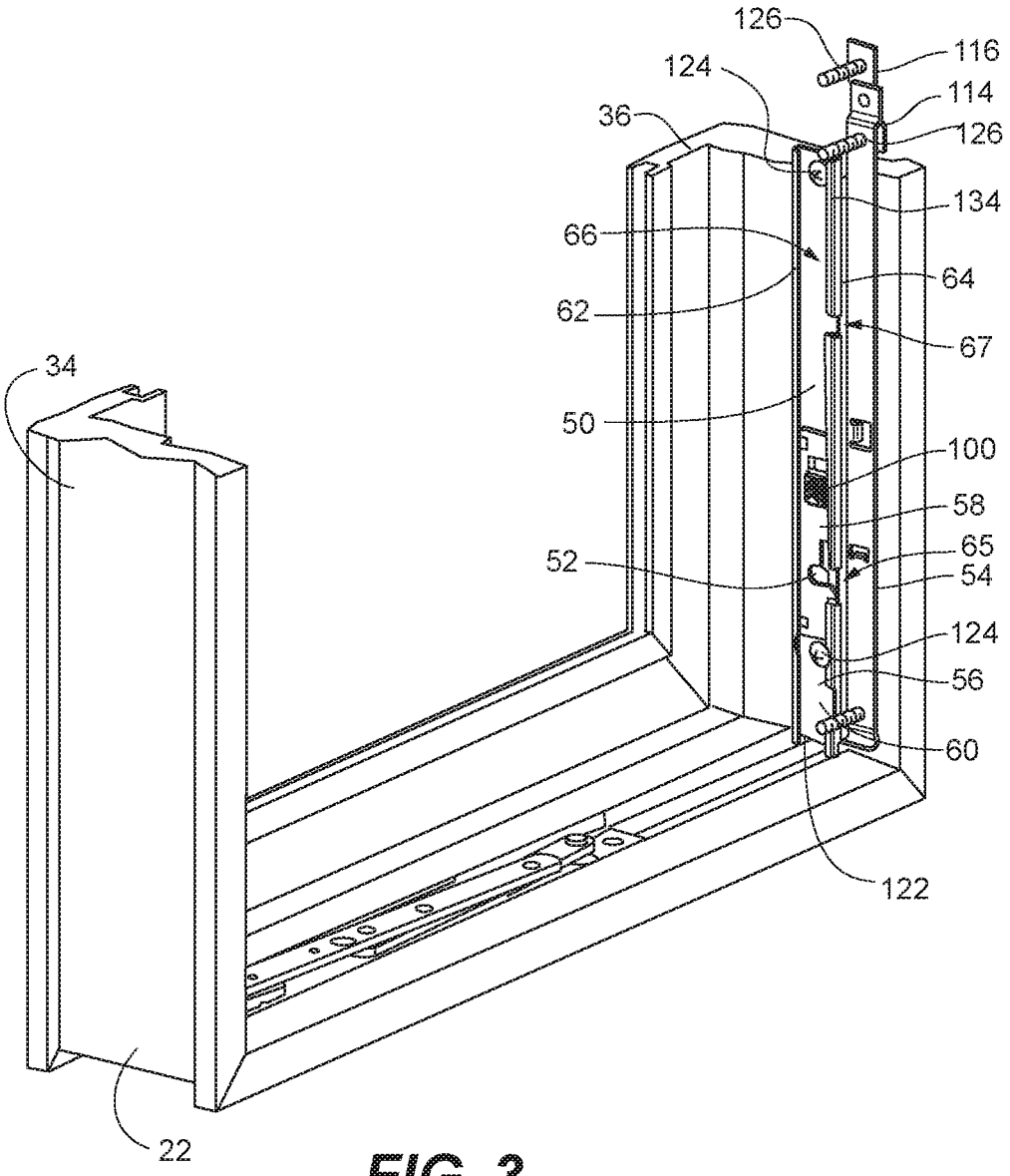
FIG. 3 depicts the casement window and window opening control device of FIG. 2, with the sash of the window nearly closed and just prior to reengagement of the window opening control device after having been released.
Figure 4:
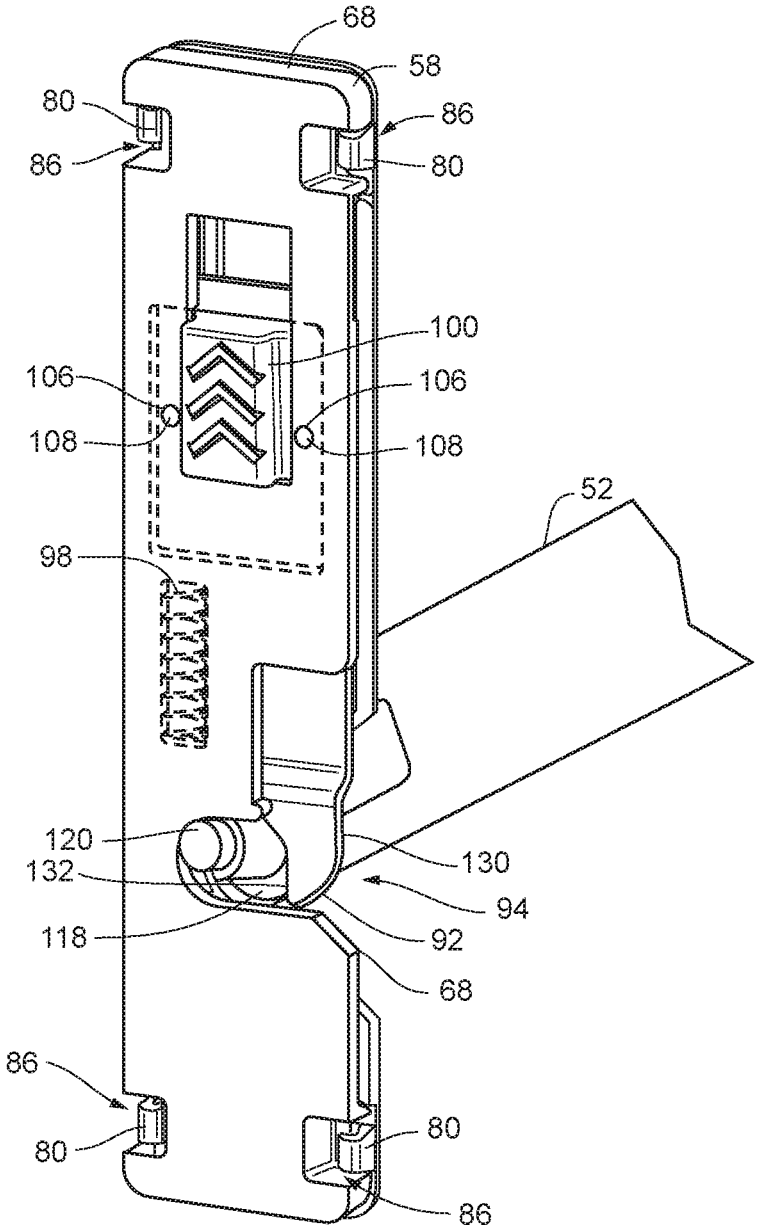
FIG. 4 is an isometric view of a carriage assembly of the window opening control device of FIG. 2 with some components shown in phantom to enable viewing of internal components.
Figure 5:
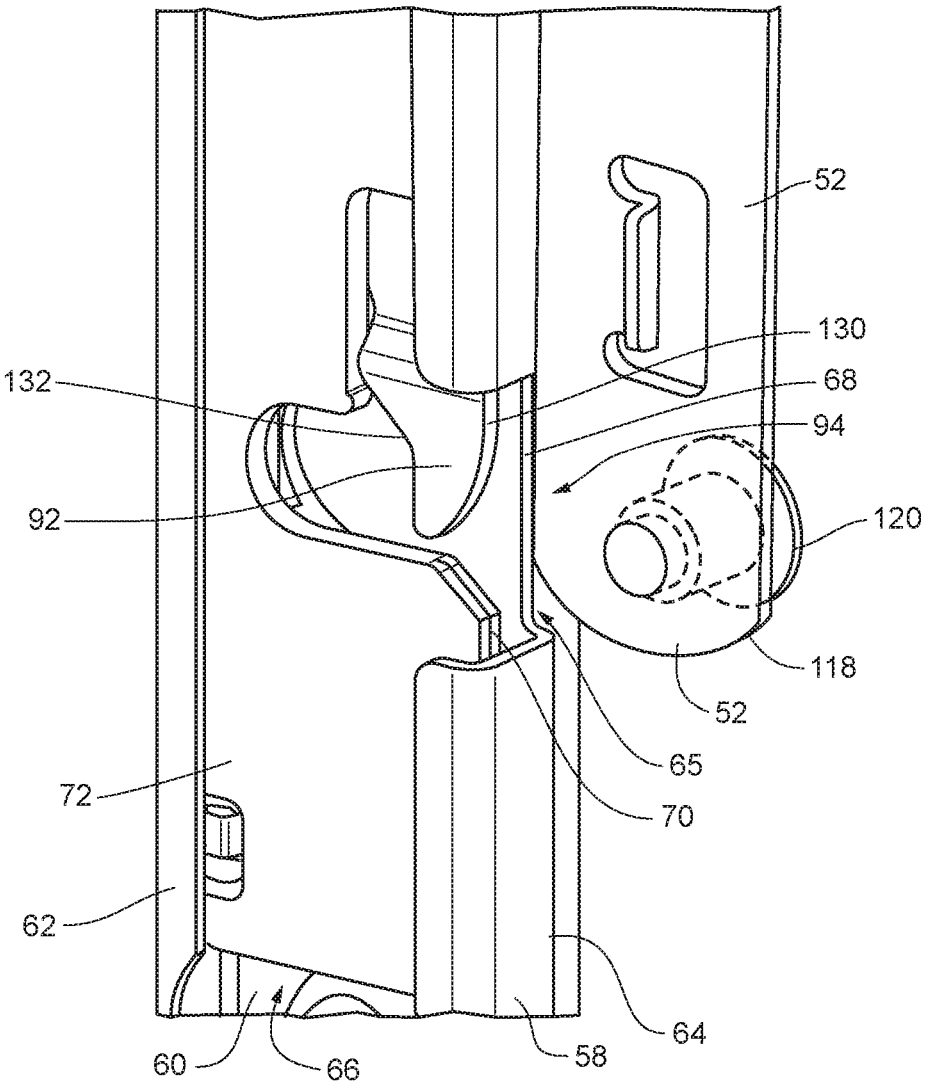
FIG. 5 is a close-up partial isometric view of the carriage assembly and limit arm of the window opening control device depicted just prior to reengagement as in FIG. 3.
Figure 6:
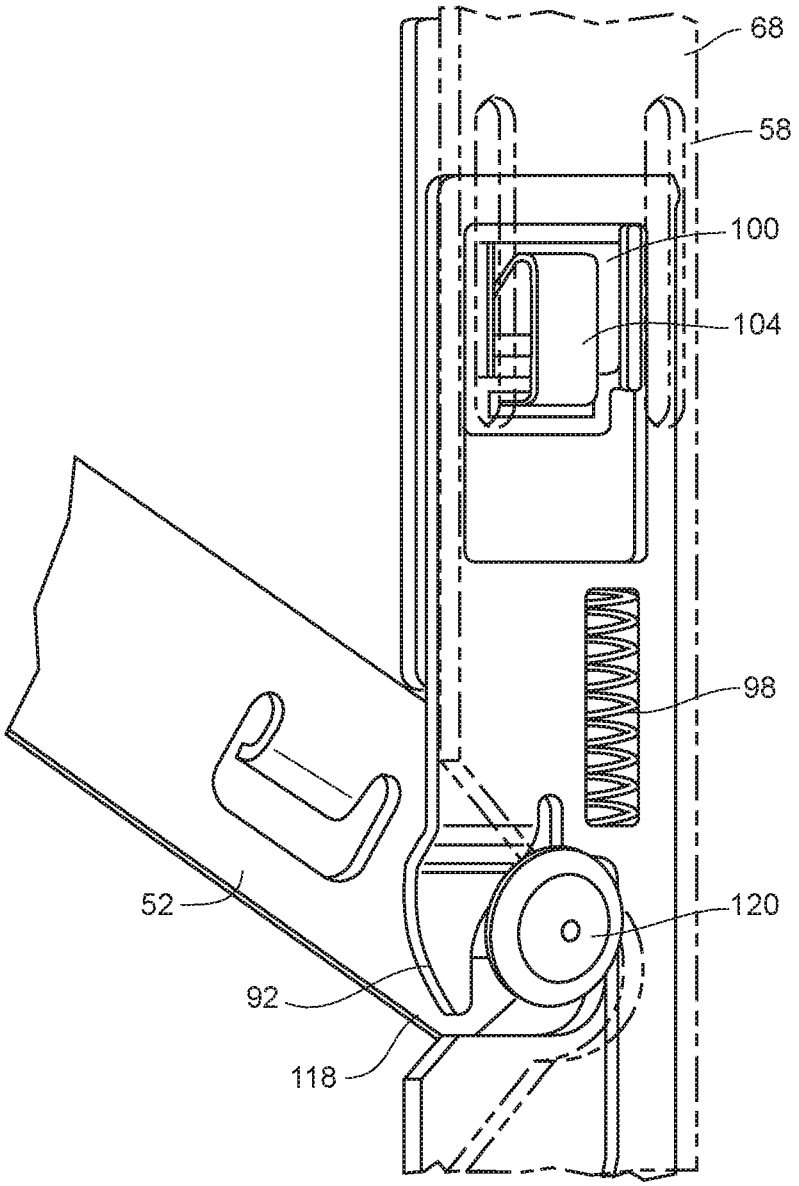
FIG. 6 is a close-up partial isometric view of the carriage assembly and limit arm of the window opening control device engaged as depicted in FIG. 2.
Figure 7:
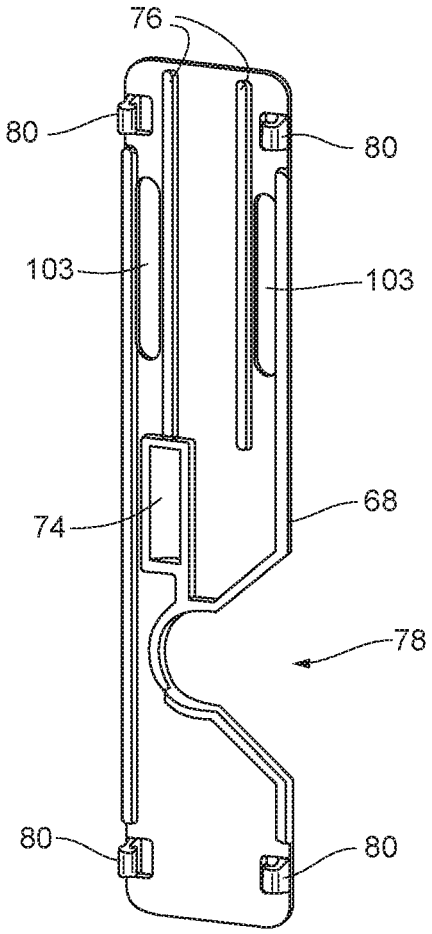
FIG. 7 is an isometric view of the back-plane portion of the housing of the carriage assembly depicted in FIG. 4.
Figure 8:
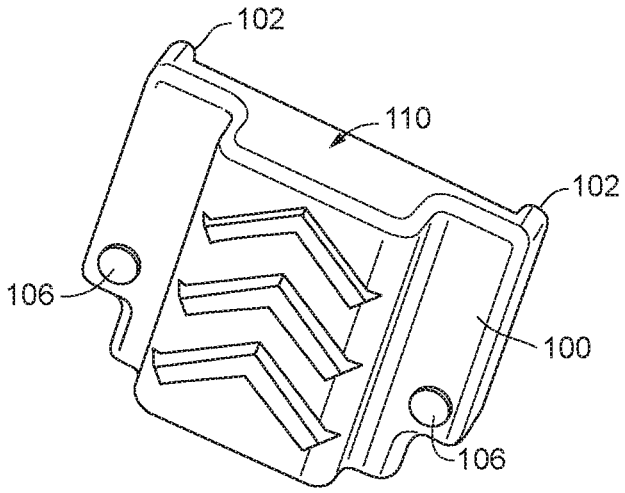
FIG. 8 is an isometric view of the release button of the carriage assembly depicted in FIG. 4.
Figure 9:
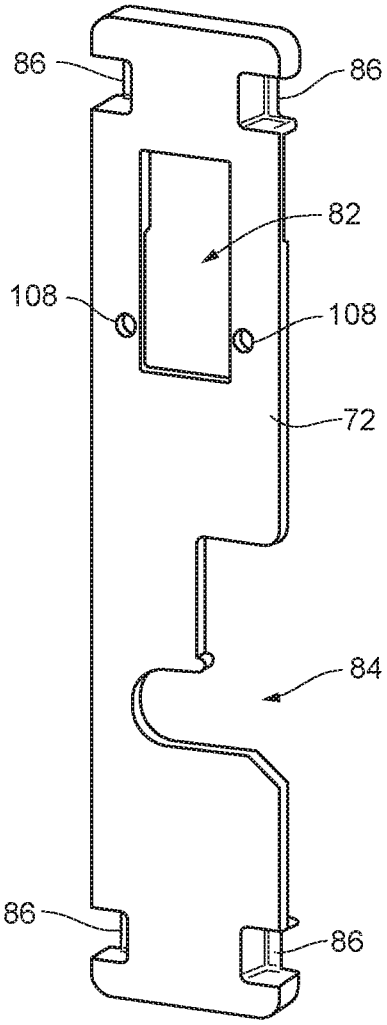
FIG. 9 is an isometric view of the front portion of the housing of the carriage assembly depicted in FIG. 4.
Figure 10:
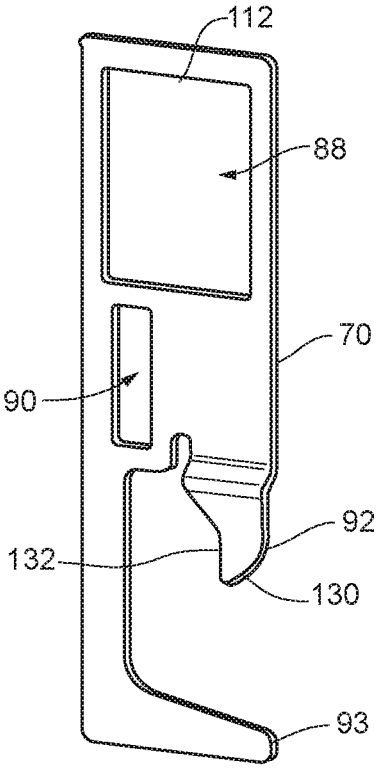
FIG. 10 is an isometric view of the latch portion of the housing of the carriage assembly depicted in FIG. 4.
Figure 13:
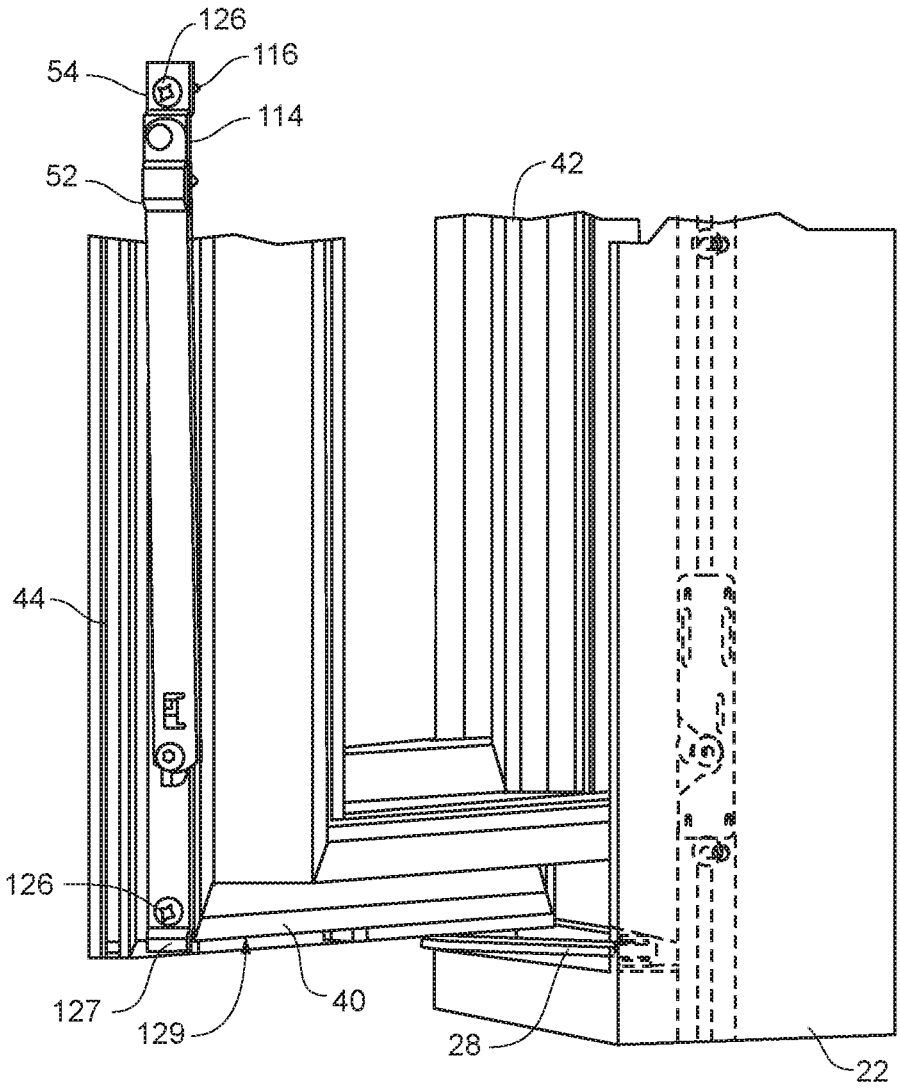
FIG. 13 depicts a casement window and window opening control device according to an embodiment of the invention, with the sash of the window open and not restrained by the window opening control device, the frame of the window being depicted in phantom.

In operation, fastening button 120 can be engaged in recess 94 behind latch hook 92 by advancing sash 26 toward the closed position as depicted in FIG. 3. Carriage assembly 58 rests proximate bottom end 122 of track 56. Fastening button 120 is registered with entrance opening 65 so that as sash 26 is completely closed, fastening button 120 passes through entrance opening 65 and bears against curved edge 130 of latch hook 96, thereby urging latch plate 70 upwardly against the bias of spring 98. It will be appreciated that fastening button 120 may bear against any portion of curved edge 130 that is exposed in recess 94, thereby accounting for a degree of misalignment between sash 26 and frame 22 such as may occur with "sash sag" over time, while still enabling proper operation of window opening control device 48. Once fastening button 120 passes inner edge 132 of latch hook 96, latch plate 70 shifts downwardly, urged by spring 98, thereby capturing fastening button 120 in recess 94 behind latch hook 96. As such, window opening control device 48 is automatically reengaged upon closing of sash 26.

Figure 2:
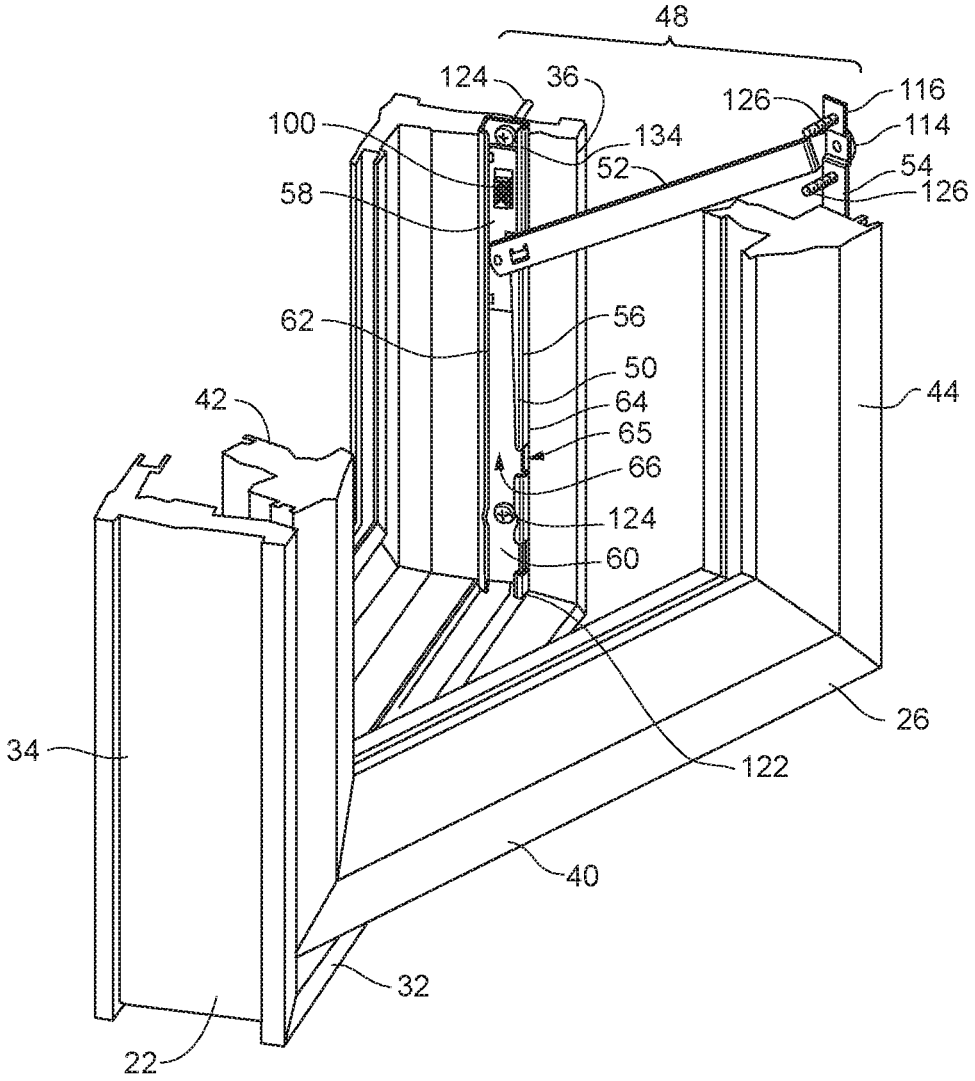
FIG. 2 depicts a casement window and window opening control device according to an embodiment of the invention, with the sash of the window open and restrained by the window opening control device.

As sash 26 is opened, carriage assembly 58 slides upwardly in track 56 as depicted in FIG. 2. Limit arm 52 pivots relative to sash attachment member 54. Once carriage assembly 58 reaches top end 134 of track 56, limit arm 52 prevents sash 26 from being opened further beyond an initial range of opening travel defined by the length of limit arm 52. With carriage assembly 58 in this position, recess 94 is aligned with exit opening 67. Limit arm 52 can be released by pressing latch button 100 against the bias of biasing spring 104, thereby disengaging projections 106 from apertures 108, enabling latch button 100 to be slid upwardly. As latch button 100 is slid upward, top face 110 of latch button 100 bears against top edge 112 of opening 88 in latch plate 70, thereby urging latch plate 70 upward against the bias of spring 98 and moving latch hook 96 clear of recess 94. Sash 26 can then be opened further beyond the initial range of opening travel, with fastening button 120 passing through exit opening 67. Once fastening button 120 clears exit opening 67, limit arm 52 pivots downward, thereby aligning fastening button 120 with entrance opening 65 so that when sash 26 is closed, window opening control device 48 is automatically reengaged.

Once upward pressure on fastening button 120 is no longer applied, spring 98 urges latch plate 70 downward, along with latch button 100. When projections 106 register with apertures 108, biasing spring 104 urges latch button 100 outwardly, thereby reengaging projections 106 in apertures 108.

Advantages of embodiments of the invention are that the sash sub-assembly and frame sub-assemblies are self-locating by virtue of having the bottom end of each sub-assembly being easily aligned with physical features of the window. This saves time and effort in installation by not requiring measurements to ensure that fastening button 120 is aligned with entrance opening 95 regardless of the dimensions of frame 22 and sash 26. Also, operation of the release of limit arm 52 is intuitive, requiring only pressing in on latch button 100 and sliding it upwardly to effect release. Operation of the device is compliant with ASTM standard F2090, requiring two different types of action to effect release. In addition, the mechanics of operation of latch button 100 assists in preventing unintended release of limit arm 52, thereby providing additional safety.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A window opening control device comprising:

a track assembly adapted to be attached to a frame of a casement window, the track assembly including a track and a carriage assembly slidable in the track, wherein the carriage assembly includes a housing defining a recess and a latch plate slidably received in the housing, the latch plate having a latch hook, the carriage assembly further including a latch button operable to selectively shift the latch plate between a latched position wherein the latch hook extends into the recess, and an unlatched position wherein the latch hook is retracted from the recess;

a sash attachment member adapted to attach to a sash of the easement window, the sash attachment member having an upper end; and a limit arm presenting a first end and a second end, the first end of the limit arm pivotally coupled to the sash attachment member proximate the upper end of the sash attachment member, the limit arm having a fastening button projecting outwardly therefrom proximate the second end, wherein in a window opening limiting condition, the fastening button is engaged with the carriage assembly so that an initial range of opening travel of the sash is limited by the limit arm, wherein in a released condition the fastening button is free from the carriage assembly, thereby enabling the sash to be opened beyond the initial range of opening travel, and wherein when the sash is closed, the fastening button automatically reengages with the carriage assembly after release.

2. The window opening control device of claim 1, wherein the limit arm is released by a first pressing movement and a second sliding movement of the latch button.

3. The window opening control device of claim 1, wherein the limit arm includes a projecting fastening button, the fastening button being engaged in the recess behind the latch hook when the window opening control device is in the window opening limiting condition.

4. The window opening control device of claim 1, wherein when a bottom end of the track is abutted with a bottom member of the frame and a bottom end of the sash attachment member is aligned with a bottom edge of a bottom rail of the sash, the fastening button is registered with the recess when the window opening control device is in the released condition.

5. The window opening control device of claim 1, wherein the latch plate is spring-biased toward the latched position.

6. A casement window window comprising:

a frame defining an opening;

a sash hinged to the frame to selectively close the opening; and a window opening control device comprising:

a track assembly attached to the frame, the track assembly including a track and a carriage assembly slidable in the track, wherein the carriage assembly includes a housing defining a recess and a latch plate slidably received in the housing, the latch plate having a latch hook, the carriage assembly further including a latch button operable to selectively shift the latch plate between a latched position wherein the latch hook extends into the recess, and an unlatched position wherein the latch hook is retracted from the recess;

a sash attachment member attached to the sash, the sash attachment member having an upper end; and a limit arm presenting a first end and a second end, the first end of the limit arm pivotally coupled to the sash, attachment member proximate the upper end of the sash attachment member, the limit arm having a fastening button projecting outwardly therefrom proximate the second end, wherein in a window opening limiting condition, the fastening button is engaged with the carriage assembly so that an initial range of opening travel of the sash is limited by the limit arm, wherein in a released condition the fastening button is free from the carriage assembly, thereby enabling the sash to be opened beyond the initial range of opening travel, and wherein when the sash is closed, the fastening button automatically reengages with the carriage assembly after release.

7. The casement window of claim 6, wherein the limit arm is released by a first pressing movement and a second sliding movement of the latch button.

8. The casement window of claim 6, wherein the limit arm includes a projecting fastening button, the fastening button being engaged in the recess behind the latch hook when the window opening control device is in the window opening limiting condition.

9. The casement window of claim 6, wherein when a bottom end of the track is abutted with a bottom member of the frame and a bottom end of the sash attachment member is aligned with a bottom edge of a bottom rail of the sash, the fastening button is registered with the recess when the window opening control device is in the released condition.

10. The casement window of claim 6, wherein the latch plate is spring-biased toward the latched position.

* * * * *